US009623278B2

(12) United States Patent
Saltzman

(10) Patent No.: US 9,623,278 B2
(45) **Date of Patent: *Apr. 18, 2017**

(54) EXERCISE MAT

(71) Applicant: Daniel Saltzman, Chicago, IL (US)

(72) Inventor: Daniel Saltzman, Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/006,824

(22) Filed: Jan. 26, 2016

(65) Prior Publication Data

US 2016/0136476 A1 May 19, 2016

Related U.S. Application Data

(63) Continuation of application No. 13/732,234, filed on Dec. 31, 2012, now Pat. No. 9,241,589.

(60) Provisional application No. 61/581,611, filed on Dec. 29, 2011, provisional application No. 61/681,480, filed on Aug. 9, 2012.

(51) Int. Cl.

| | |
|---|---|
| ***A47G 9/06*** | (2006.01) |
| ***A63B 6/00*** | (2006.01) |
| ***A63B 21/00*** | (2006.01) |
| ***A63B 23/035*** | (2006.01) |
| ***A47G 27/02*** | (2006.01) |
| *A63B 23/00* | (2006.01) |

(52) U.S. Cl.

CPC ..... *A63B 21/4037* (2015.10); *A47G 27/0237* (2013.01); *A63B 6/00* (2013.01); *A63B 21/00178* (2013.01); *A63B 21/15* (2013.01); *A63B 23/035* (2013.01); *A63B 23/03516* (2013.01); *A47G 9/062* (2013.01); *A63B 2023/006* (2013.01)

(58) Field of Classification Search

CPC ..... A47G 9/062; A47G 9/06; A63B 21/1743; A63B 21/00105; A63B 6/00; G08B 19/00; G08B 19/02; G08B 23/02; G08B 23/04; G01B 21/02; G01B 21/04; G01B 21/047; G06G 1/00; G06G 1/0005; G06G 1/02

USPC ..... 5/417, 420; 482/23; D6/582; 33/452–456, 1 B, 1 N; 434/198, 199, 434/211–216; 235/61 R, 61 B, 61 G

See application file for complete search history.

(56) References Cited

U.S. PATENT DOCUMENTS

| | | | | |
|---|---|---|---|---|
| 2,005,659 A * | 6/1935 | Matteson | A47L 23/24 | 40/618 |
| 5,071,130 A * | 12/1991 | Shofner | A63B 69/3667 | 473/218 |
| 5,386,654 A * | 2/1995 | Kroenke | B26D 7/20 | 223/69 |
| 7,465,263 B1 * | 12/2008 | Conrad | A63B 21/4037 | 434/393 |
| 9,241,589 B2 * | 1/2016 | Saltzman | A63B 21/1473 | |

(Continued)

*Primary Examiner* — Robert G Santos

(74) *Attorney, Agent, or Firm* — The Concept Law Group, P.A.; Scott D. Smiley; Erin A. Martin

(57) ABSTRACT

An exercise mat including a material sized and shaped to support at least one user body part thereon, the material having an upper planar surface, a single starting point representing a number zero on the upper planar surface, and at least two series of sequential integers disposed on the upper planar surface and extending from the single starting point. Each of the at least two series of sequential integers corresponding to a coordinate and placement site for a body part of a user to facilitate measurement of a linear distance along the upper planar surface.

20 Claims, 10 Drawing Sheets

(56) References Cited

U.S. PATENT DOCUMENTS

| | | | | |
|---|---|---|---|---|
| 2013/0180048 | A1* | 7/2013 | Saltzman | A63B 21/1473 5/417 |
| 2016/0136476 | A1* | 5/2016 | Saltzman | A63B 23/035 5/417 |

* cited by examiner (VIEW A OF FIG.1A)

(VIEW B OF FIG.1A)

VIEW C OF FIG.6

VIEW D OF FIG.6

VIEW E OF FIG.6

EXERCISE MAT

CROSS-REFERENCE TO RELATED APPLICATION

This application is a continuation of U.S. Nonprovisional patent application Ser. No. 13/732,234, filed Dec. 31, 2012, now U.S. Pat. No. 9,241,589, which claims the benefit of U.S. Provisional Patent Application No. 61/581,611, filed Dec. 29, 2011, and U.S. Provisional Patent Application No. 61/681,480, filed Aug. 9, 2012, the entirety of which are incorporated by reference.

BACKGROUND OF THE INVENTION

The present invention relates to an Exercise Yoga mat that includes a design on the mat that helps a yoga practitioner properly measure body placement during postures. Until this invention, Exercise Yoga mats were either entirely blank or had lines and designs printed to aid the practitioner with placement. However, none of these give the user the tools to identify the measured distances they are performing poses in.

Yoga has many poses that require a person's contact point foundation to have one or both feet and/or hands on the mat. If the foundation for a particular pose entails at least 2 contact points, this invention allows one to measure the distances between them. By knowing the distances of body placement, one can identify which distances are comfortable, stay consistent from practice to practice, and keep track of progress. In addition, it would be very simple for a teacher to aid the practitioner by identifying to them which spot and what exact distances to perform a pose in. People come in varying sizes and flexibility abilities, lines and designs on one mat may not be entirely suitable for each varying person using that mat. This mat with measurements allows all varieties of people and skill level to find their comfortable positions on the mat, and measure the distances they have performed. For instance, if a shorter person can only stretch out 8 inches, a taller person may be able to measure 12 inches out. Or a shorter person with good flexibility may be able to measure out 12 inches as well. This mat will show exactly how far out one can stretch, irregardless of size and flexibility ability.

FIELD OF THE INVENTION

The invention is in the exercise/yoga mat field and performing exercises within

SUMMARY OF THE INVENTION

The present invention is a yoga/exercise mat that allows a practitioner to numerically measure ones poses and track his or her flexibility progress during the Exercise Yoga practice. The distance markings can be along the outer edges of the mat, and/or at each spot on the mat.

Two spots on the mat are ideal to be used as starting points for measurements. One can choose a corner to start from, or one can start from the center of the mat. Each spot on the mat has a linear direct distance associated with it from this start point, a horizontal distance from the start point associated with it and a vertical distance from the start point associated with it. For purposes of description, we will call the combination of the horizontal and vertical distances associated with a spot as its 'coordinates'. In a preferred embodiment it is easiest to place these markings/coordinates at one-inch intervals along the mat on a continuous horizontal and vertical plane.

By having spots on the mat that identify distances, one can place any 2 body extremities on the mat and now measure the distances between them. This is essential for tracking, improving, consistency.

In one embodiment, the invention includes a method of performing yoga exercises comprising:

providing a yoga mat having an upper planar surface, a lower planar surface, a series of printed indicia on at least one of the surfaces constructed and arranged to measure varying distances along the upper planar surface of said yoga mat;

positioning a user on said upper planar surface, executing a yoga position by said user; and measuring at least one distance of a user's hand or foot relative to one or more of other users hands and feet or to other marked indicia on the mat.

The method in one embodiment is on a mat that is free of grid lines. In another embodiment, the mat has grid lines connecting the measuring spots.

The method includes providing the mat as being labeled with distance indicia.

In another embodiment, the invention is a method of performing yoga exercises comprising:

providing a yoga mat having an upper planar surface, a lower planar surface and a center point, printed indicia denoting said center point, a series of printed indicia constructed and arranged to measure linear distance from said center point along either planar surface of said yoga mat;

positioning a user on said center point;

executing a yoga position by said user; and measuring at least one distance of a user's hand or foot from at least one of a center point, a perpendicular point along the center horizontal midpoint line of mat, a perpendicular point along the vertical midpoint line of mat, or any combination thereof providing at least one of linear, horizontal, vertical measurements to at least one of a user's hand or foot when the hand or foot is placed on the mat. As used herein, surface, is either planar surface of the mat. The surface is generally viewed as the side facing upwards during yoga or exercise use. In one embodiment, the surfaces have different indicia that provide different measurements and indicators for varying yoga exercises.

The method includes one embodiment whereby the printed indicia is connected using grid lines and one embodiment wherein the indicia is free of grid lines.

The method includes providing the mat with printed indicia that includes points equidistantly spaced from said center point.

In one embodiment, the mat is divided into four quadrants that are identically labeled with distance indicia.

The printed indicia includes points equidistantly spaced from either a center point or a starting point, the starting point, as used herein, being a point on the mat other than the center point, said indicia providing horizontal and vertical distance from said perpendicular points along the vertical or horizontal midpoints of the mat.

The printed indicia includes points equidistantly spaced from the center point or starting point, said indicia providing horizontal and vertical distance from said center point The invention further provides a yoga mat comprising: an upper planar surface, a lower planar surface and a center point, or a starting point, the starting point being a point on the mat other than the center point, wherein printed indicia denotes at least one of a center point or staring point, a series of printed indicia constructed and arranged to measure linear distance from said center point along the upper planar surface of said yoga mat.

In one embodiment, the mat is free of grid lines.

The printed indicia includes points or spots that are equidistantly spaced from center point or starting point. The yoga mat is preferably divided into four quadrants that are identically labeled with distance indicia. The printed indicia includes points equidistantly spaced from center point or starting point, said indicia providing horizontal and vertical distance from said center point.

The printed indicia includes points equidistantly spaced from said center point or starting point and said indicia provides visual indication for a user to determine horizontal and vertical distance from said center point.

In a preferred embodiment that will be detailed and focused on more thoroughly has the measurements starting from a center point on the mat and working outward in 4 directions.

DETAILED DESCRIPTION OF THE PREFERRED EMBODIMENT

Figure 5:
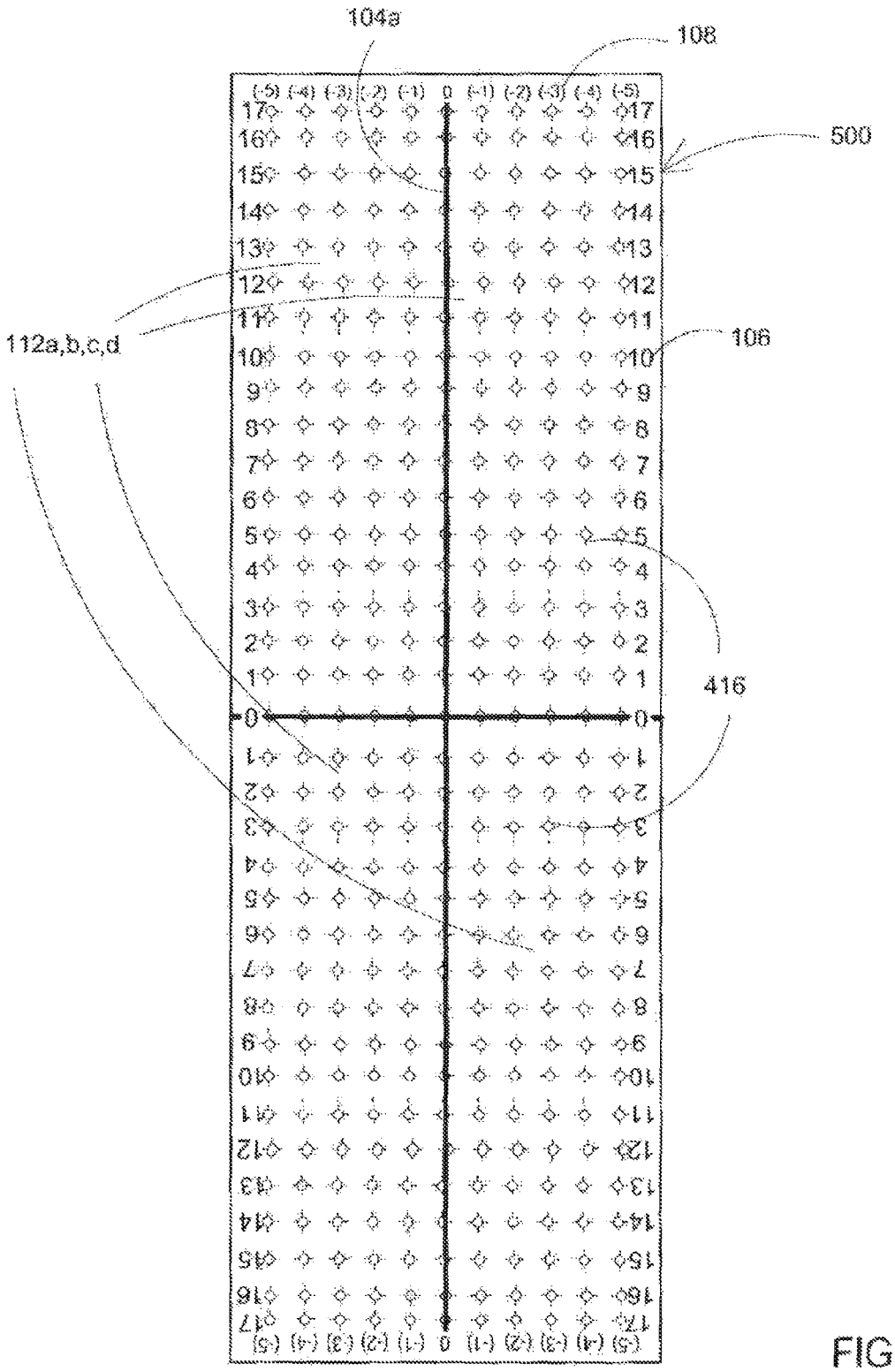
FIG. 5 is a view of an embodiment of the mat according to the present invention without the grid axis "500" design.
Figure 6:
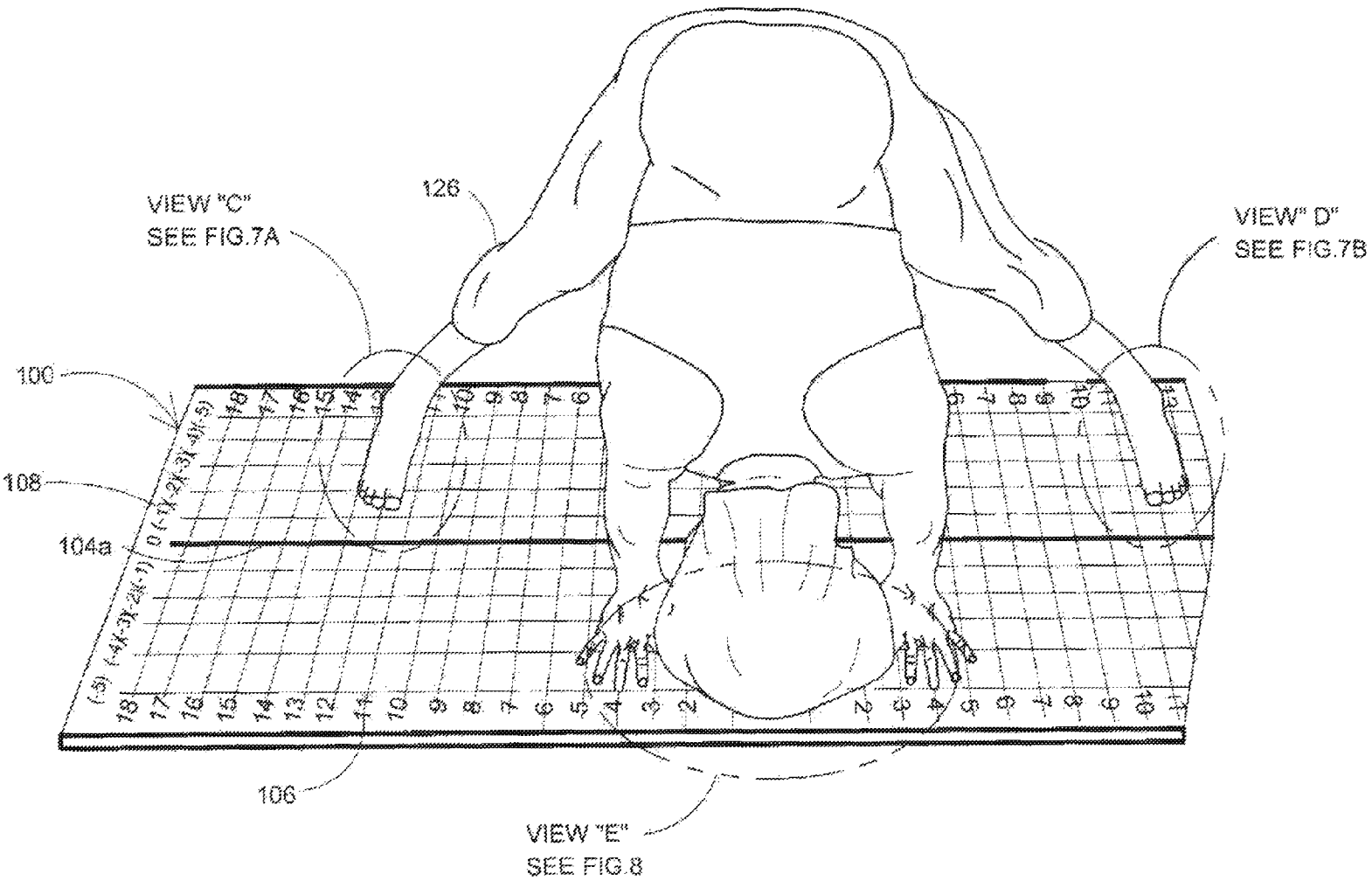
FIG. 6 is a view of mat 100 showing an environment of use with a person in a forward bend pose.
Figure 7A:
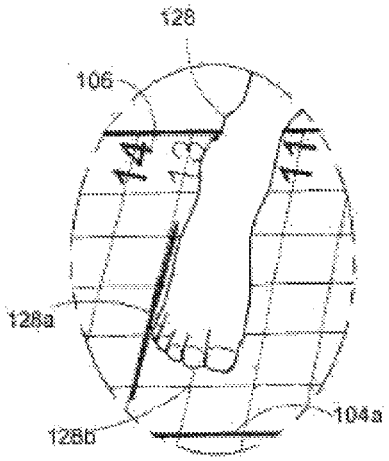
FIG. 7A is an enlarged view of section "C" of FIG. 6.
Figure 7B:
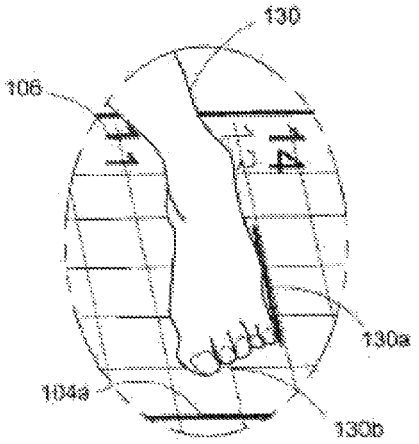
FIG. 7B is an enlarged view of section "D" of FIG. 6.
Figure 8:
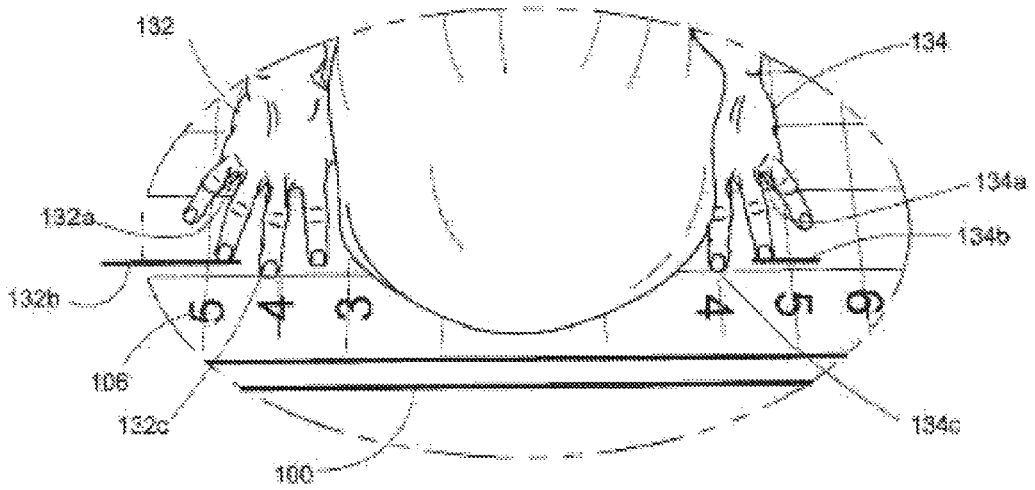
FIG. 8 is an enlarged view of section "E" of FIG. 6

As generally described herein the present invention includes a yoga mat and a method for performing and measuring yoga maneuvers utilizing said mat. It is to be understood that the accompanying figures are meant for illustrative purposes and are not intended to limit the present invention to the particular embodiments displayed thereon. For example, although the drawings show particular symbols denoting varying numbers, the invention relates to the general geography whereby the person's hands and/or feet are oriented and aligned on the yoga mat, and measurements from those points. In one embodiment, particularized grid markings can be used to connect spot measurement indicia. Additionally, the present invention encompasses a mat such as that shown in FIG. 5, wherein no particular grid lines are present but wherein indicia is provided for measurement during yoga exercises.

Figure 1A:
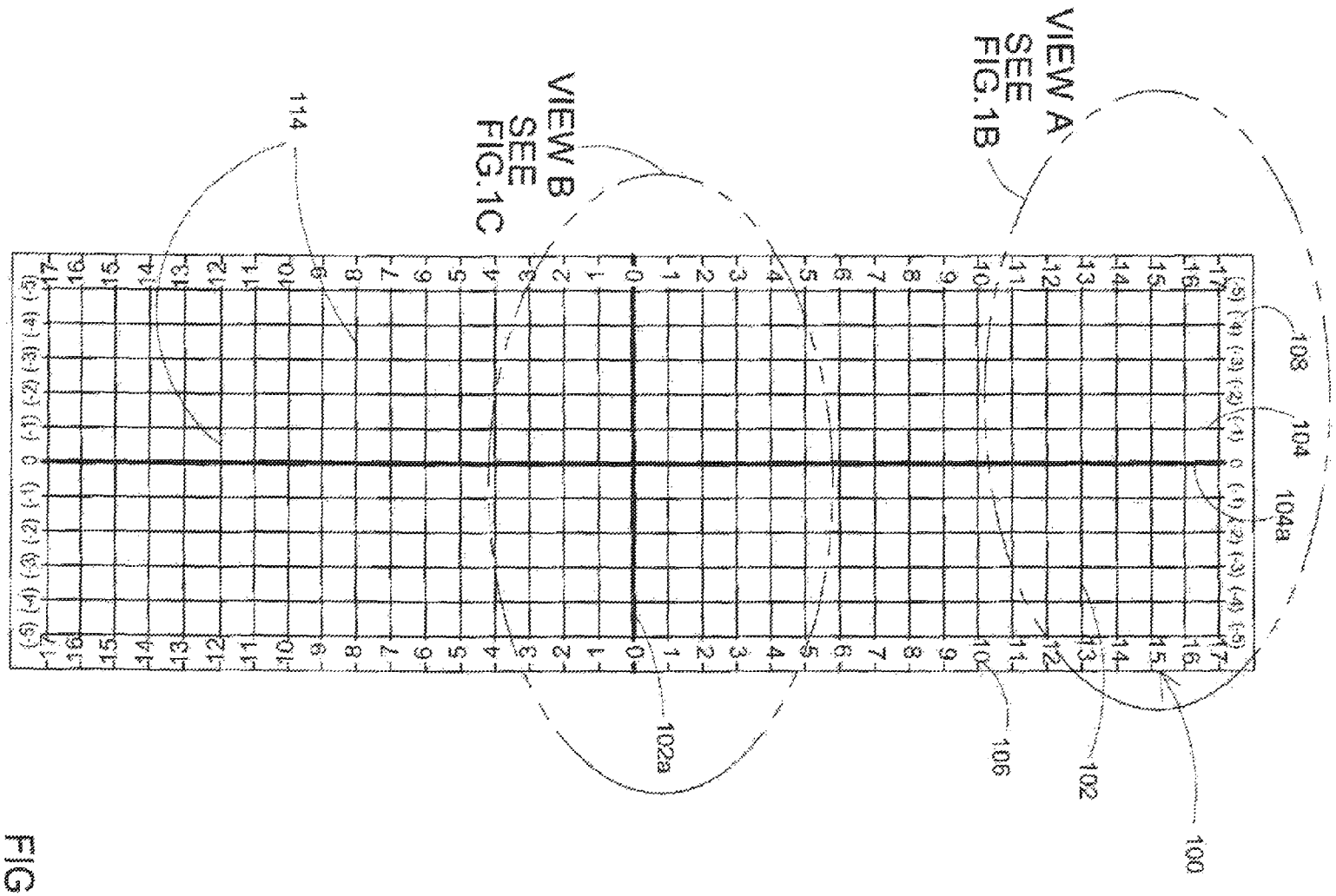
FIG. 1A is the view a mat according to the present invention with the "100th" design.
Figure 1B:
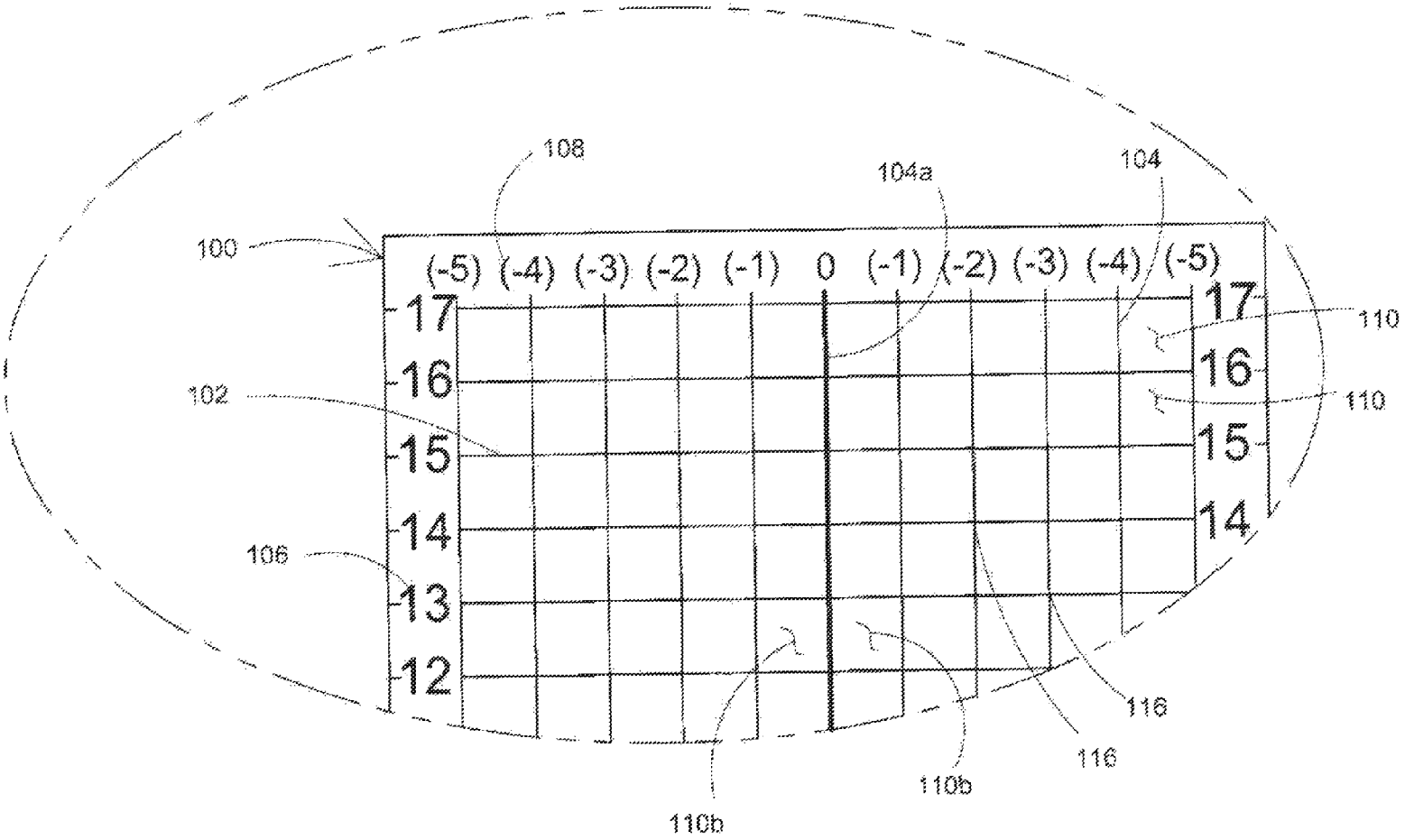
FIG. 1B is enlarged view from section "A" of FIG. 1A.
Figure 1C:
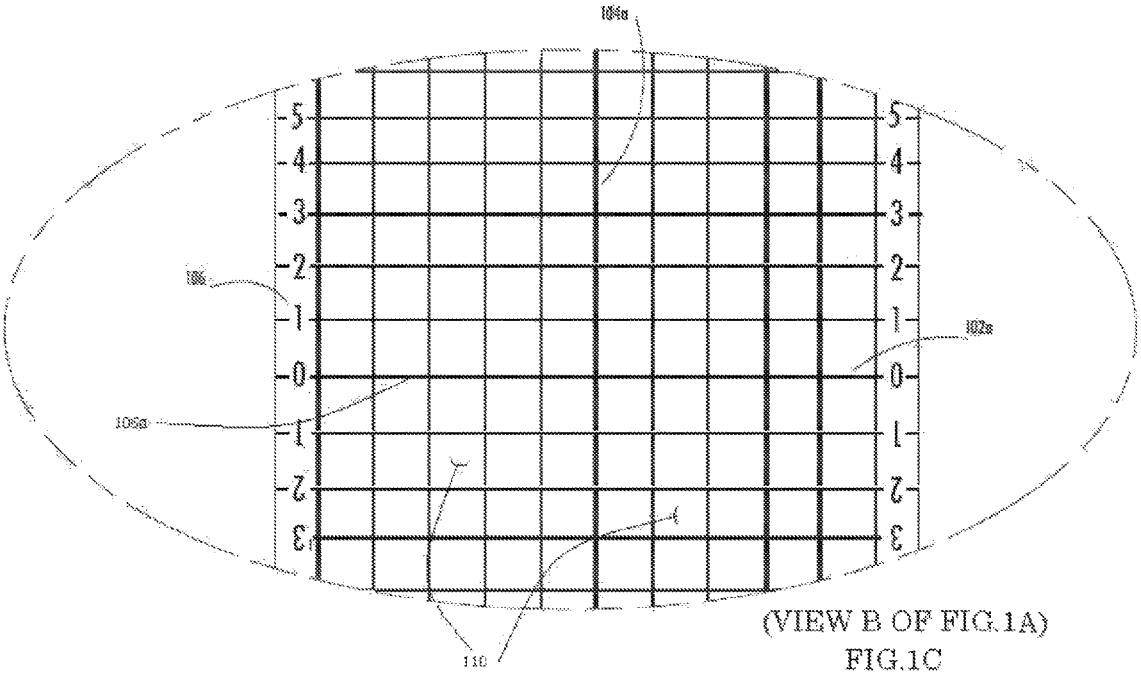
FIG. 1C is an enlarged view of section "B" of FIG. 1A.
Figure 2:
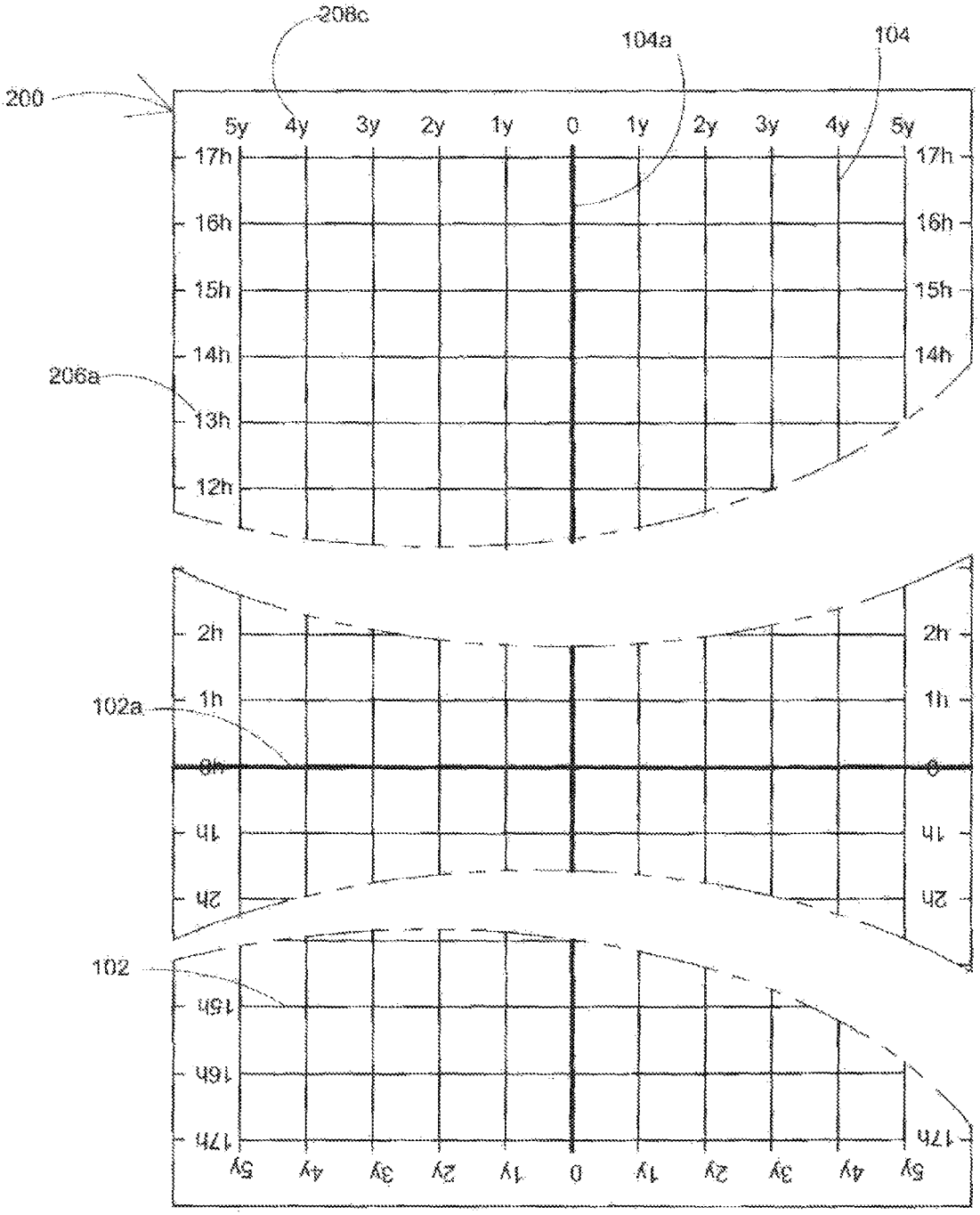
FIG. 2 is a view of the mat "200" using alternative indicia of the present invention with the "100" design.
Figure 3:
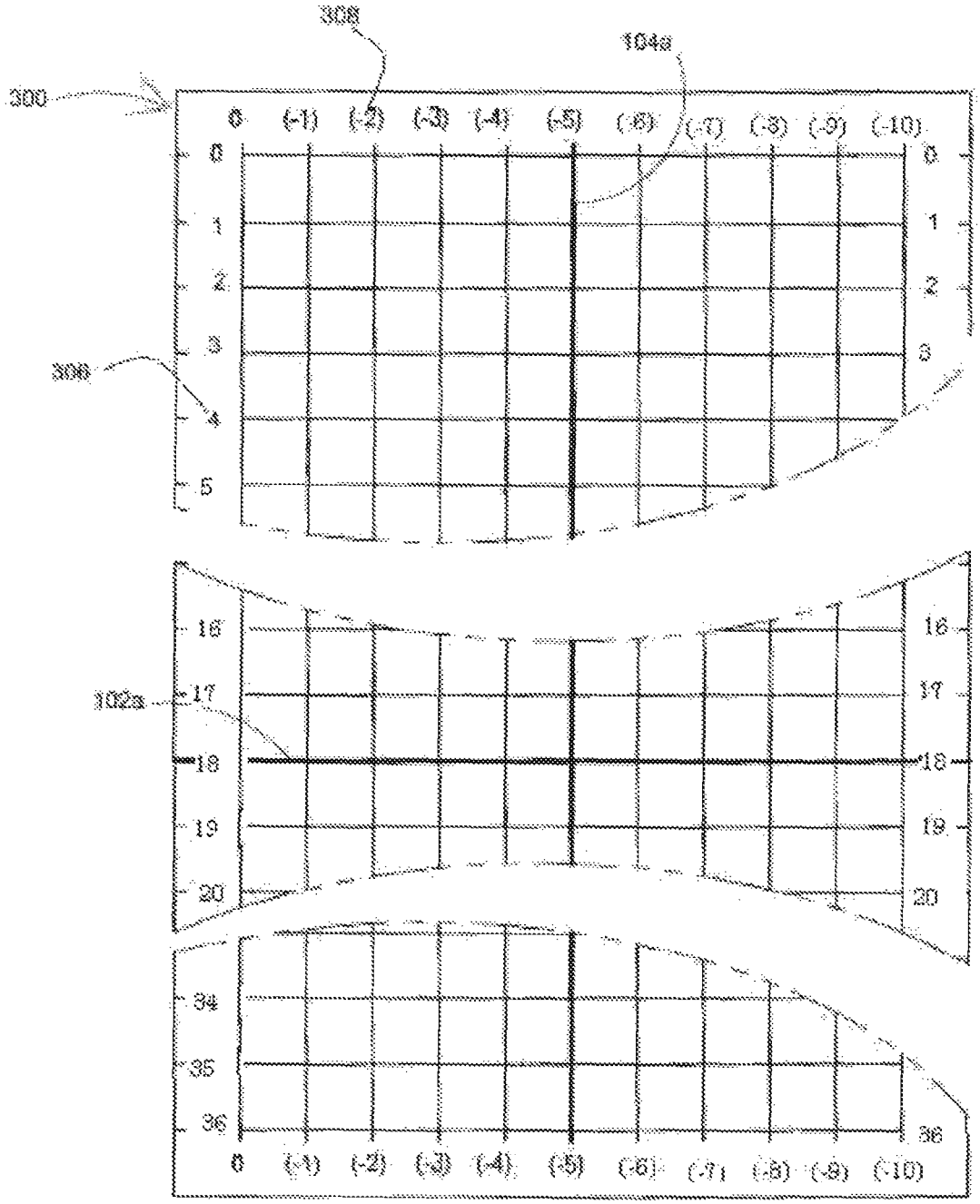
FIG. 3 is a view of an embodiment of the mat according to the present invention with the mat corner start non-symmetrical "300" design.

As shown in FIG. 1 Exercise Yoga mat 100 is provided with a generally planar surface printed with indicia. In one embodiment horizontal indicia 106 and vertical indicia 108 are printed on mat 100. In one embodiment, each of indicia 106 and 108 are sequentially numbered. Mat 100 is divided into two halves 110 and four equally sized quadrants 112. Each of two halves 110 of mat 100 are constructed and arranged in orientation such that one half of mat 110 is upside down with respect to the opposing half. Each of the two halves 110 of mat 100 includes two quadrants of mat 100 that are mirror images of one another. Yoga mat 100 in one embodiment is printed with equal distance horizontal indicia 106, legends 0-18 (2 inches apart for example) equal distance vertical indicia 108 legends 0-(−5) (2 inches apart). As previously discussed, each quadrant is substantially a mirror image of another. In one embodiment, horizontal indicia 106 and vertical indicia 108 printed on yoga mat 100 are spaced equally apart as desired. For example, indicia could be provided at one inch or two-inch intervals. Horizontal indicia 106 with connecting horizontal lines 102, and vertical indicia 108 with connecting vertical lines 104 provide a visual aid with numbered measurements to give the user a specific visual reference spot as to placement of body parts during yoga exercise poses.

Horizontal centerline 102 a divides mat 100 into substantially into two horizontally equal halves.

Mat 100 additionally has vertical centerline 104A that divides mat 100 into substantially into two vertical halves.

Two equal horizontal halves 110 *a* are preferably symmetrically placed with respect to horizontal centerline 102 *a* forming mirror images of one another.

Two equal vertical halves 110 *b* are preferably symmetrically placed with respect to vertical centerline 104 *a* forming mirror images of one another.

In one embodiment four equal quadrants 112 are formed by printed indicia in which yoga mat 100 is divided into two equal horizontal halves 110 *a* and two equal vertical halves 110 *b*.

Each of the four equal quadrants 112 *a*, 112 *b* 112 *c*, 112 *d* are labeled in a similar pattern as defined by using horizontal indicia 106 and vertical indicia 108

These 4 quadrant identifying labels presume that the user is at the center on yoga mat 100 and has shoulders horizontally aligned so that 112 *a* is at front left of users facing direction.

front left quadrant 112 *a;*
front right quadrant 112 *b;*
back left quadrant 112 *c*; and
back right quadrant 112 *d.*

The final four equal quadrants 112 being symmetrically oriented in relation to horizontal center line 102(*a*) and vertical center line 104 (*a*)

In one embodiment, graph axis 114 is a uniform grid like pattern resulting from connecting horizontal lines 102 and connecting vertical lines 104 on yoga mat 100.

Coordinate measurement spots 116 are the spots on yoga mat 100 which are specific measured points on graph axis 114 resulting from where horizontal indicia 106 and vertical indicia 108 intersect. For example, a Coordinate measurement spot 116 will have intersecting spot of horizontal indicia 106, measurement 8, and vertical indicia 108, measurement (−3), to be Coordinate measurement spot 116, 8(−3), on Graph axis 114. 4(−4), 11(0), 0(−5), 17(−1) etc. can be other Coordinate measurement spots 116. Another example, where Horizontal centerline 102(*a*) and Vertical center line 104(*a*) intersect, will be labeled Coordinate measurement spot 116, 0(0).

Forward bend pose 126 is a yoga pose that the user or exerciser uses on yoga mat 100. Forward bend pose 126 *a* requires the body to be positioned with the shoulders parallel with vertical indicia 108 on yoga mat 100. With this body/shoulder alignment along the vertical indicia 108, the quadrant in front right will now be 112 *a*—will now be to the persons front right . . . as opposed to 112 *a* being at the persons front left if one is aligned with shoulders parallel to horizontal indicia 106;

front right quadrant 112 *b*—will now be to the persons back right;

back left quadrant 112 *c*—will now be to the persons front left; and back right quadrant 112 *d*—will now be to the persons back left.

Forward bend pose right foot 128 is a part of Forward bend pose 126 identifying the placement of the users right foot on Graph axis 114. Forward bend pose left foot 130 is a part of Forward bend pose 126 identifying the placement of the users left foot on Graph axis 114. Forward bend pose right hand 132 is a part of forward bend pose 126 identifying the placement of the user's right hand on Graph axis 114. Forward bend pose left hand 134 is a part of forward bend pose 126 identifying the placement of the user's left hand on graph axis 114.

The user practicing forward bend pose vertical 126 will then use graph axis 114 to align themselves properly with both hands and both feet. One then places each body contact point on the same horizontal plane and/or the same vertical plane and can easily measure distances. A user for instance will place Forward bend pose right foot 128 in quadrant 112 *b* on Coordinate measurement spot 116 10(−1), and forward bend pose left foot 130 in quadrant 112*d* on Coordinate measurement spot 116, 10(−1). The user will then place Forward bend pose right hand 132 in quadrant 112 *a* on Coordinate measurement spot 116 5(−2), and Forward bend pose left hand 134 in back left quadrant 112 *c* on Coordinate measurement spot 116 5(−2), establishing the users body position in proper alignment and symmetry, and for quick measurement using the sum of the Coordinate measurement spots 116 from feet placement along the horizontal indicia 106 plane, and then also the sum of the Coordinate measurement spots 116 from hand placement along the horizontal indicia 106 plane.

In this example, assume the indicia on the mat are measured out at 1 inch from each other, the feet will result in being 20 inches apart, and the hands result in being 10 inches apart from each other.

Each embodiment disclosed herein is used either singularly or otherwise combined with any of the other embodiments disclosed. Any element of any embodiment will be used in any embodiment.

Embodiments include, for example, other labels that are used instead of numbers. For example, letters, a different alphabet and/or numbering system could be used; for example, Roman numerals could be used instead of the letters and/or numbers and the Greek alphabet, Hiragana alphabet, Sanskrit, the Mayan alphabet, various yoga symbols or signs, nature related symbols, colors, any symbols or signs, or another alphabet could be used instead of the English alphabet. The modification includes any indicia including numbers, letter, symbols and the like.

In certain embodiments, indicia will be spaced by an amount that is different than 1 or 2 inches apart, such as a distance between 1-4 inches, or fractional/decimal distances, (e.g., 1.5, 1.6, 1.7, 1.8, 1.9, 2.1, 2.2, 2.3, 2.4 or 2.5 inches/mm).

Mat 300 is constructed and arranged with measurement indicia start point in one of the mat corners, resulting in a sequential series along the mats perimeters with an assymetrical measuring method.

Figure 4:
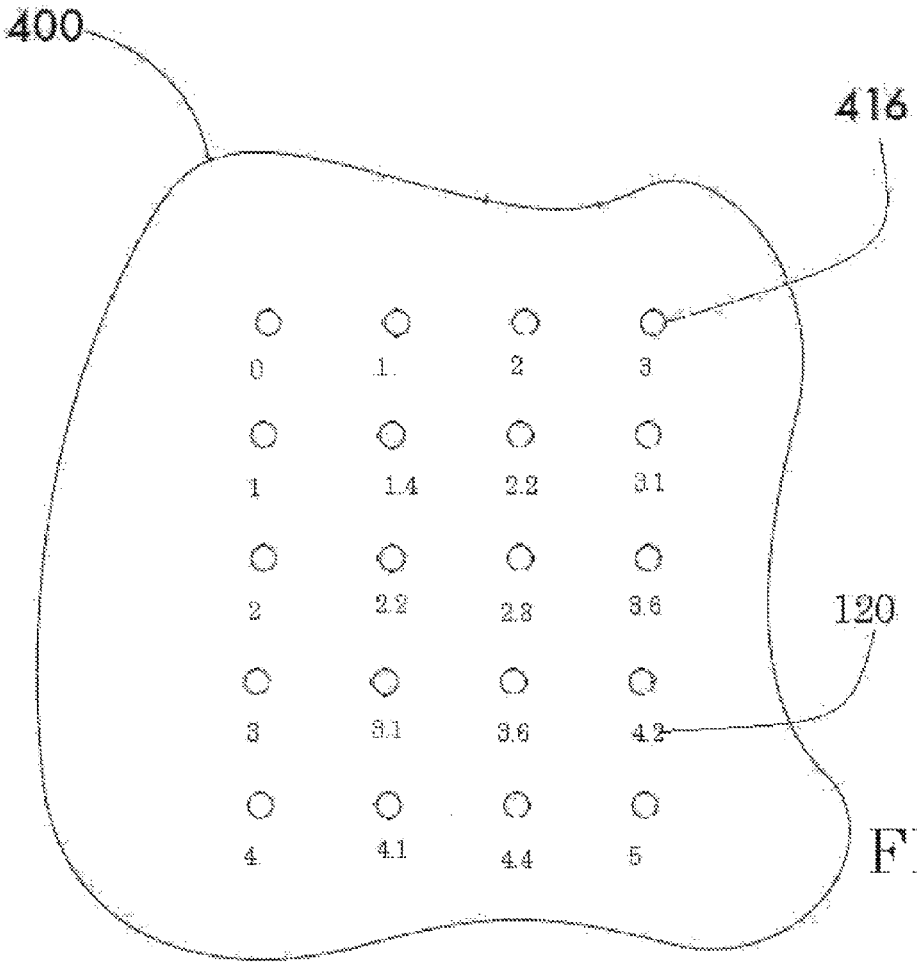
FIG. 4 is a partial view of an embodiment of the mat according to the present invention with linear indicia "400" design.

FIG. 4 is a partial view of an embodiment of the mat according to the present invention with a linear indicia "400" design. Mat 400 is constructed and arranged with a plurality of linear indicia 120 measurement spots 416 along horizontal and vertical planes illustrated at right angles. Measurement spots 416, in one embodiment are spaced equidistant one to another throughout mat 400. In another embodiment, spots 416 are spaced exponentially or gradated, meaning gradually larger or smaller in distance. As provided herein, spots 416 can also be color-coded to indicate any one or all of horizontal, vertical, or diagonal distance along mat 400. In the illustrated embodiment of FIG. 4, measurement spots 416 form an exemplary matrix four across and five down spaced equidistant one to another throughout mat 400. Each measurement spot 416 is depicted with number indicia printed on the mat. In the partial view embodiment of FIG. 4, the measurements spots in a first row across are numbered 0, 1, 2, and 3. In the partial view embodiment of FIG. 4, the measurements sports in a first column down across are numbered 0, 1, 2, 3, and 4. In the partial view embodiment of FIG. 4, the measurement spot numbered 0 is a single starting point. In the partial embodiment of FIG. 4, the other measurement spots are decimals such as 1.4, 2.2, 3.1, 3.6, 4.2, 4.4, and 5. The number indicia corresponding to each of the measurement spots 416 illustrated in the partial view embodiment of FIG. 4 is the hypotenuse of a right-angled triangle which can be established using the known geometric Pythagorean theorem equation $a^2+b^2=c^2$, wherein the measurement spots in the first row across can be a, the measurement spots in the first column down can be b and the remaining measurement sports of the decimals can be c. Each decimal illustrated meets the Pythagorean theorem equation truncated to one decimal place. Therefore, the illustrated print number indicia corresponding to each measurement spot 416 represents a linear distance along the surface of the yoga mat from that measurement spot to the single starting point 0.

Mat 500 is an embodiment where each spot 416 is related to indicia 106 and indicia 108 positioned along the perimeter of mat 500, but designed without horizontal lines 102 and vertical lines 104.

Any Exercise Yoga mat of the invention is contemplated constructed in many varieties, the material for Exercise Yoga mat 100,200,300,400,500 the numbers and letters sequencing, the space between the lines indicia, the thickness of the lines indicia, spot markings at each line indicia intersection, spot markings at center of each indicia, yoga mat 100,200, 300,400,500 with a single graph axis direction, embroidered mat instead of printed, on a towel, on a device that can be attached or sealed or printed or taped on to any kind of Exercise Yoga mat, regardless of material thickness or general makeup of the Exercise Yoga mat, on floor in a gym, an item with measurements for exercise measurement and form, can be used for any sport that entails both body placement and/or form, (kickboxing, martial arts), round Exercise Yoga mats, various mat shapes, various mat sizes, thickness and shapes, diagonal lines, linear distances indicia 120, indicia commonly found on a ruler, equal graph lines indicia. The material used for the mat will be any flexible material, for example such as bamboo, rubber, foam, PVC, eco-friendly.

While the invention has been described in its preferred form or embodiment with some degree of particularity, it is understood that this description has been given only by way of example and that numerous changes in the details of construction, fabrication, and use, including the combination and arrangement of parts, may be made without departing from the spirit and scope of the invention.

What is claimed is:

1. An exercise mat comprising:

a single layer of flexible material sized and shaped to support at least one user body part thereon, the material having:

an upper planar surface including a length and a width;

a single starting point representing a number zero on the upper planar surface; and at least two series of sequential integers disposed on the upper planar surface and extending from the single starting point, each of the at least two series of sequential integers corresponding to a coordinate and placement site for a body part of a user to facilitate measurement of a linear distance along the upper planar surface, the coordinate and placement sites together extending substantially the length and the width of the upper planar surface.

2. The exercise mat according to claim 1, wherein:

the at least two series of sequential integers are removably coupled to the upper planar surface.

3. The exercise mat according to claim 1, wherein:

the upper planar surface is divided into at least two quadrants, the at least two quadrants being mirror images of each other.

4. The exercise mat according to claim 1, further comprising:

a plurality of horizontal grid lines disposed on the upper planar surface; and a plurality of vertical grid lines each intersecting the plurality of horizontal grid lines to form the coordinate.

5. The exercise mat according to claim 1, wherein:

the at least two series of sequential integers are equidistantly spaced from each other.

6. An exercise mat comprising:

a single layer of flexible material sized and shaped to support at least one user body part thereon, the material having:

an upper planar surface including a length and a width;

a single starting point on the upper planar surface;

a plurality of sequential integers disposed on the upper planar surface and extending from the single starting point; and a plurality of location indicia corresponding to each of the plurality of sequential integers and representing a reference spot for placement of a body part of a user, the plurality of location indicia extending substantially the length and the width of the upper planar surface.

7. The exercise mat according to claim 6, wherein:

the upper planar surface includes at least two quadrants; and the plurality of sequential integers in a first one of the at least two quadrants are a mirror image of the plurality of sequential integers in a second one of the at least two quadrants.

8. The exercise mat according to claim 6, wherein:

the plurality of sequential integers are equidistantly spaced from each other.

9. The exercise mat according to claim 6, wherein:

the plurality of location indicia include at least one horizontal line intersecting at least one vertical line to form the reference spot.

10. The exercise mat according to claim 6, wherein:

the plurality of location indicia include the reference spot disposed on a horizontal line and a vertical line.

11. The exercise mat according to claim 6, further comprising:

the single starting point disposed on a center portion of the upper planar surface.

12. The exercise mat according to claim 6, wherein:

the single starting point is a number zero.

13. The exercise mat according to claim 6, wherein:

the upper planar surface includes a sequence of four quadrants.

14. The exercise mat according to claim 6, wherein:

the plurality of sequential integers are removably coupled to the upper planar surface.

15. An exercise system for measuring poses comprising:

a device for supporting at least one user body part thereon, the device having:

a layer of flexible material sized and shaped to support at least one user body part;

an upper planar surface including a single starting point representing a zero point, a length, and a width;

a plurality of horizontal integers disposed on the upper planar surface and extending in a direction away from the single starting point, the plurality of horizontal integers corresponding to a horizontal line of a measurement spot for placement of a user's body part, the horizontal line extending substantially the width of the upper planar surface; and a plurality of vertical integers disposed on the upper planar surface and extending in a direction away from the single starting point, the plurality of vertical integers corresponding to a vertical line of a measurement spot for placement of a user's body part, the vertical line extending substantially the length of the upper planar surface.

16. The exercise system according to claim 15, wherein:

the upper planar surface includes at least two halves, each of the at least two halves being mirror images of each other.

17. The exercise system according to claim 15, further comprising:

a plurality of horizontal lines extending from the plurality of horizontal integers; and a plurality of vertical lines extending from the plurality of vertical integers, at least one of the plurality of vertical lines intersecting at least one of the plurality of horizontal lines to form the measurement spot.

18. The exercise system according to claim 15, wherein:

the plurality of horizontal integers and the plurality of vertical integers are removably coupled to the upper planar surface.

19. The exercise system according to claim 15, wherein:

the plurality of horizontal integers are equidistantly spaced from each other; and the plurality of vertical integers are equidistantly spaced from each other.

20. The exercise system according to claim 15, wherein:

the measurement spot is represented by a single measurement point independent of a measurement line.

* * * * *